US007013517B2

(12) United States Patent
Kropf

(10) Patent No.: US 7,013,517 B2
(45) Date of Patent: Mar. 21, 2006

(54) ROTATING/TIPPING AGITATOR FOR A WASHING MACHINE

(75) Inventor: Keith E. Kropf, Newton, IA (US)

(73) Assignee: Maytag Corp., Newton, IA (US)

( * ) Notice: Subject to any disclaimer, the term of this patent is extended or adjusted under 35 U.S.C. 154(b) by 549 days.

(21) Appl. No.: 10/318,125

(22) Filed: Dec. 13, 2002

(65) Prior Publication Data

US 2004/0111809 A1 Jun. 17, 2004

(51) Int. Cl.
*D06F 23/00* (2006.01)

(52) U.S. Cl. ..... 8/159; 68/23.7; 68/133

(58) Field of Classification Search ..... 8/159; 68/23 R, 23.7, 133, 134, 53; 74/60; 475/163
See application file for complete search history.

(56) References Cited

U.S. PATENT DOCUMENTS

| | | | |
|---|---|---|---|
| 1,553,690 | A | 9/1925 | Hogan |
| 2,140,866 | A | 12/1938 | Whyte |
| 2,145,453 | A | 1/1939 | Miller |
| 2,186,786 | A | 1/1940 | Jensen |
| 2,186,797 | A | 1/1940 | Beattie |
| 2,215,288 | A | 9/1940 | Hays |
| 2,350,218 | A | 5/1944 | De Remer |
| 2,363,184 | A | 11/1944 | Jacobs |
| 2,372,769 | A | 4/1945 | De Remer |
| 2,520,366 | A | 8/1950 | Kirby |
| 2,554,573 | A | 5/1951 | Johnson |
| 2,555,400 | A | 6/1951 | De Remer |
| 2,574,170 | A | 11/1951 | Cockerill et al. |
| 2,645,111 | A | 7/1953 | Fields |
| 2,658,372 | A | 11/1953 | Kirby |
| 2,695,510 | A | 11/1954 | Clark |
| 2,715,826 | A | 8/1955 | Kirby |
| 2,823,975 | A | 2/1958 | Kirby |
| 2,831,333 | A | 4/1958 | Smith |
| 2,871,689 | A | 2/1959 | Fields |
| 2,902,851 | A | 9/1959 | Fields |
| 2,902,852 | A | 9/1959 | Fields |
| 2,921,459 | A | 1/1960 | Long |
| 2,921,460 | A | 1/1960 | Aberle |
| 2,924,086 | A | 2/1960 | Fields |
| 2,931,201 | A | 4/1960 | Hubbard |
| 2,948,128 | A | 8/1960 | Smith |
| 2,974,515 | A | 3/1961 | Smith et al. |
| 2,982,120 | A | 5/1961 | Pelensky |
| 2,990,709 | A | 7/1961 | Bochan |
| 2,993,388 | A | 7/1961 | Brill et al. |
| 3,013,645 | A | 12/1961 | Goodlaxson |
| 3,063,280 | A | 11/1962 | Bonner |
| 3,067,603 | A | 12/1962 | Devery |
| 3,102,408 | A | 9/1963 | Pelensky |
| 3,102,410 | A | 9/1963 | Doyle |
| 3,279,224 | A | 10/1966 | Zaidan |
| 3,952,557 | A | 4/1976 | Bochan |

(Continued)

*Primary Examiner*—Joseph L. Perrin
(74) *Attorney, Agent, or Firm*—Diederiks & Whitelaw, PLC

(57) ABSTRACT

A combination rotating/tipping mechanism for an agitator arranged in an inner tub of a washing machine includes a drive member, a tipping member fixedly mounted to the agitator and pivotally mounted to the drive member, and a pivot link interconnecting the tipping member and the inner tub of the machine. In operation, rotation of the drive member imparts an oscillating/rotating motion to the tipping member about a rotational axis. Simultaneously, the pivot link is caused to pivot about a pivotal axis, thereby restricting the movement of the tipping member and causing the tipping member to pivot about another pivotal axis.

18 Claims, 6 Drawing Sheets

U.S. PATENT DOCUMENTS 3,987,652 A * 10/1976 Ruble ..... 68/134
4,054,412 A 10/1977 Brummett et al.
4,328,600 A 5/1982 Bochan
4,440,004 A 4/1984 Bochan
5,460,018 A 10/1995 Werner et al.
5,504,955 A 4/1996 Mueller et al.
5,507,053 A 4/1996 Mueller et al.
5,590,550 A * 1/1997 Savkar et al. ..... 68/133
5,791,167 A 8/1998 Wyatt et al.
6,227,013 B1 * 5/2001 Wyatt-Smith ..... 68/134
6,604,389 B1 * 8/2003 Skvarla et al. ..... 68/23.6
2003/0154749 A1 * 8/2003 Kim et al ..... 68/23.6
2004/0006830 A1 * 1/2004 Kim ..... 8/159
2004/0006831 A1 * 1/2004 Kim et al. ..... 8/159
2004/0010861 A1 * 1/2004 Kim ..... 8/159

* cited by examiner

ROTATING/TIPPING AGITATOR FOR A WASHING MACHINE

BACKGROUND OF THE INVENTION

1. Field of Invention

The present invention pertains to the art of washing machines and, more particularly, to a vertical axis washing machine including a rotating/tipping agitator.

2. Discussion of Prior Art

As environmentally friendly washing machines are more and more demanded by the public, manufacturers are faced with the problem of designing machines that use less water and, by extension, less energy to perform a washing cycle without causing a degradation in the quality of machine performance. One approach is to offer horizontal axis machines which use less water to thoroughly soak articles of clothing rotated within an inner tub. While this approach is an effective solution, it does not address the concerns of many consumers which, either by custom, or by spatial requirements, desire vertical axis machines.

Vertical axis machines have certain advantages over their horizontal axis counterparts. For example, vertical axis machines have fewer sealing requirements and therefore are less prone to leakage, and are arguably easier to load. For at least these reasons, many users find it advantageous to have a top loading machine. However, washing machine manufacturers find themselves faced with governmental regulations requiring more energy efficient laundry machines. In view of these new requirements, manufacturers have sought out designs which can make a vertical axis washer more energy efficient, while still being economically feasible. To this end, manufacturers have proposed various profile designs for agitators in attempting to more effectively move the wash load, or to vary the cycle to promote a better mixing of laundry. While each of these methods are effective to a degree, improvements are still deemed necessary.

The water level in a standard vertical axis machine cannot be lowered without negatively impacting wash performance. In addition, to effectively perform a wash cycle, the agitator must generate movement within the wash load as clothes tend to rest on the bottom of the machine and move in unison with the agitator. Tests on low water use machines have shown that some form of vertical motion is required to cause the wash load to turn over, thereby enabling each article of clothing to receive a corresponding amount of washing action.

Accordingly, a design that incorporates both the traditional oscillatory/rotating motion, coupled with a vertical or tipping motion, will enable a washing machine to use less water without negatively affecting wash quality. The prior art actually has many examples of machines that utilize a combination horizontal/vertical movement of clothing. However, most are either very complicated, possessing multiple failure points, or are not readily retrofittable to current designs, thereby not defining a cost effective solution. Accordingly, based on at least these reasons, there is a need in the art for a rotating/tipping agitator arrangement which will provide the necessary motion to clothing being washed in the tub of a vertical axis washing machine, while enabling the washing machine to utilize lower amounts of water, and be both easily serviceable and retrofittable into current designs.

SUMMARY OF THE INVENTION

The present invention pertains to a tipping mechanism, designed to impart a rotating and tipping movement to an agitator of a clothes washing machine. In accordance with a preferred embodiment of the invention, the tipping mechanism includes a unitary tipping member, a drive member, and a pivot link. The unitary tipping member includes an upper circular bracket and a pair of opposing leg extensions. Each of the leg extensions includes a first end fastened to a bottom portion of the bracket and a second end extending axially from the bracket and terminating in a pivot pin receiving journal. The drive member, which defines a rotational axis, constitutes a polygonal block having a top surface, a bottom surface, a pair of opposing faces, and a pair of opposing side portions. The drive member further includes a pair of pivot pins, respectively mounted to the pair of side portions, and a central bore adapted to receive a rotating/oscillating drive shaft extending substantially from the bottom surface to the top surface. Each of the pivot pins is adapted to engage a respective pivot journal of the tipping member such that the tipping member is pivotally connected to the drive member. The pivot link, which defines a pivotal axis, includes a first pivot ball and a second pivot ball maintained in a spaced relationship by a bar member having a first end and a second end. Each of the first and second pivot balls are preferably removably mounted to a respective one of the first and second ends of the bar member. The first end of the pivot link is pivotally connected to a spinner bracket which is maintained in a fixed relationship with respect to an inner tub of the washing machine. The second end of the pivot link is adapted to engage the upper bracket of the tipping member. With this arrangement, rotation of the drive member causes the agitator to rotate about a rotational axis and, simultaneously, pivot about the pivotal axis.

In accordance with another form of the invention, the tipping mechanism includes a modular tipping member, a drive member and a pivot link. The modular tipping member includes a first section having a pivot pin receiving journal and a pivot ball socket adapted to receive a first end of the pivot link, and a second section which is substantially a mirror image of the first section. During assembly, the pivot link is positioned in the ball socket and the drive member pivot pin is inserted into the pivot pin journal of the first section. Subsequently, the second section is mated to the first section such that the drive member and pivot link are maintained in respective positions. The modular tipping member further includes a plurality of mounting ears adapted to be fastened to the agitator such that rotation of the drive member causes the agitator to rotate about the rotational axis and, simultaneously, pivot about the pivotal axis.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE INVENTION

Figure 1:
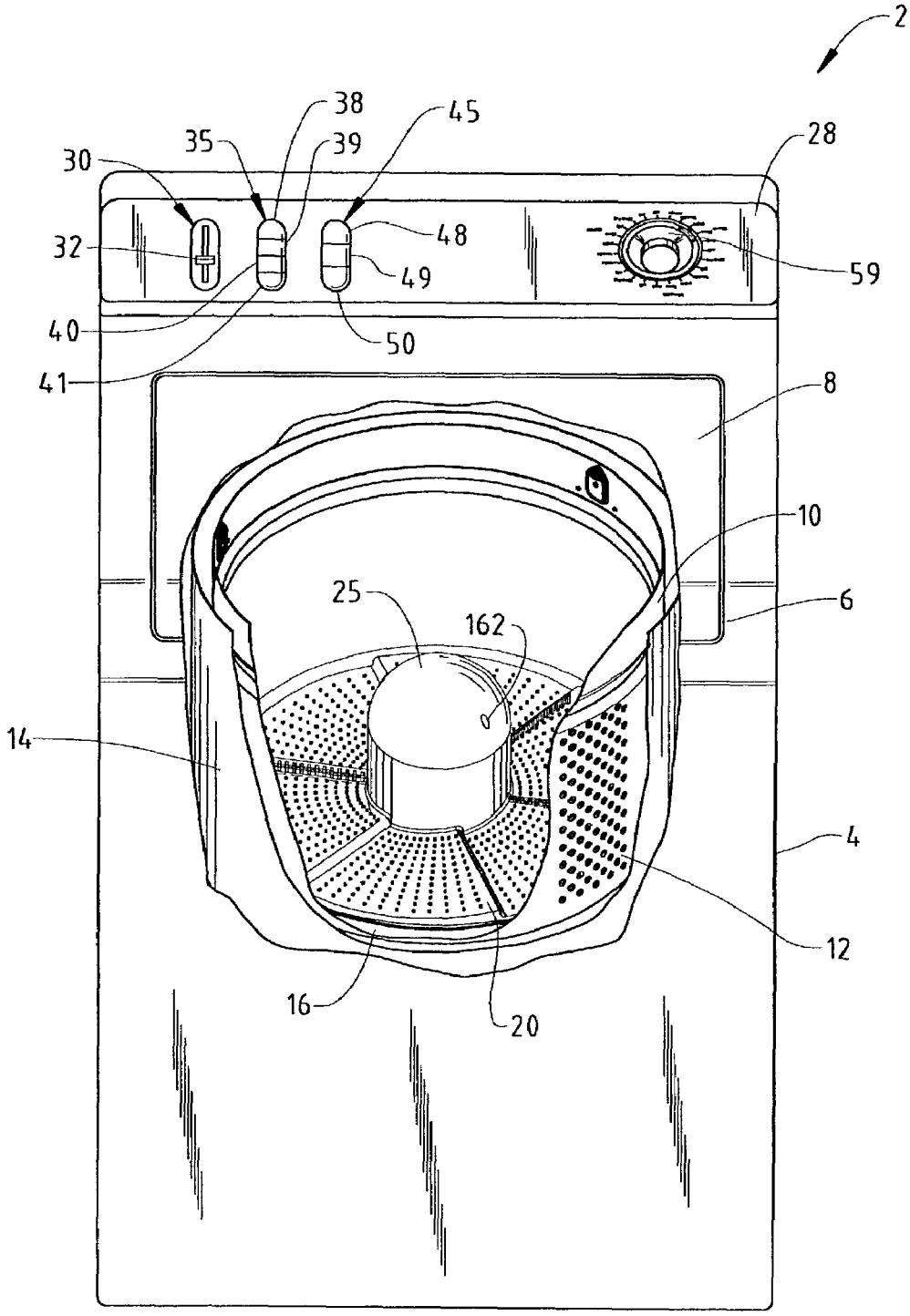
FIG. 1 is an upper perspective view of a top loading, vertical axis washing machine incorporating a rotating and tipping agitator mechanism constructed in accordance with the present invention.

With initial reference to FIG. 1, a laundry appliance constructed in accordance with the present invention is generally indicated at 2. As shown, laundry appliance 2 includes an outer cabinet shell 4 provided with an upper opening 6 that can be selectively closed by means of a pivotable lid 8. In a manner widely known in the art, lid 8 can be raised to provide access to an inner tub 10 having a plurality of drain holes 12. Inner tub 10 is rotatably mounted within an outer tub 14 and is adapted to receive clothes to be laundered. Mounted within inner tub 10 is an agitator assembly 16 having a plurality of sloped plateaus or teeth 20 and a central hub portion 25.

At a rear portion of cabinet shell 4 is arranged a control panel 28 that includes various control units which can be used to program a desired laundering operation for appliance 2. In the embodiment shown, control panel 28 includes a first control unit 30 constituted by a vertically shiftable knob 32. Knob 32 is adapted to be shifted between various positions in order to enable a user of appliance 2 to select a desired load size. Control panel 28 also includes a second control unit 35 that is defined by a plurality of buttons 38–41 provided for establishing wash and rinse temperatures. Adjacent second control unit 35 is a third control unit 45 defined by a plurality of buttons 48–50 which is used by a consumer to select a pre-established wash operation through the use of button 48, the application of a second rinse through button 49, and to cancel either of these control features through button 50. Finally, control panel 28 includes a rotary knob 59 which is used by a consumer to select a desired wash cycle.

The present invention is particularly directed to the structure which enables agitator assembly 16 to simultaneously rotate about a rotational axis and pivot about a pivotal axis to impart a combination rotating/tipping washing movement to clothes contained within inner tub 10. More specifically, with reference to both FIGS. 2 and 3, a tipping mechanism is shown to include a tipping member 70, a drive member 75, a pivot link 80, and an inner, fixedly mounted tub bracket 85. In general, tipping member 70 is pivotally mounted to drive member 75 for movement about both a rotational and a first pivotal axis 76. Pivot link 80 interconnects tipping member 70 with inner tub or spinner bracket 85 such that rotation of drive member 75 causes pivot link 80 to pivot about a second pivotal axis 82 thereby imparting vertical movement to tipping member 70 as it pivots about the first pivotal axis. Having described the interrelationship of the components, a detailed description of each of the component parts follows.

Tipping member 70 includes an upper, preferably circular bracket 90 having a central opening 91 and an upper ball receiving portion 92. Tipping member 70 further includes a pair of opposing leg portions 95. Each of the respective leg portions 95 has a first end (not separately labeled) joined to a bottom portion of bracket 90 and a second end which is axially spaced from bracket 90. Additionally, each leg portion 95 further includes a pivot receiving journal 98 adjacent a terminal portion of the second end of leg portion 95.

Figure 3:
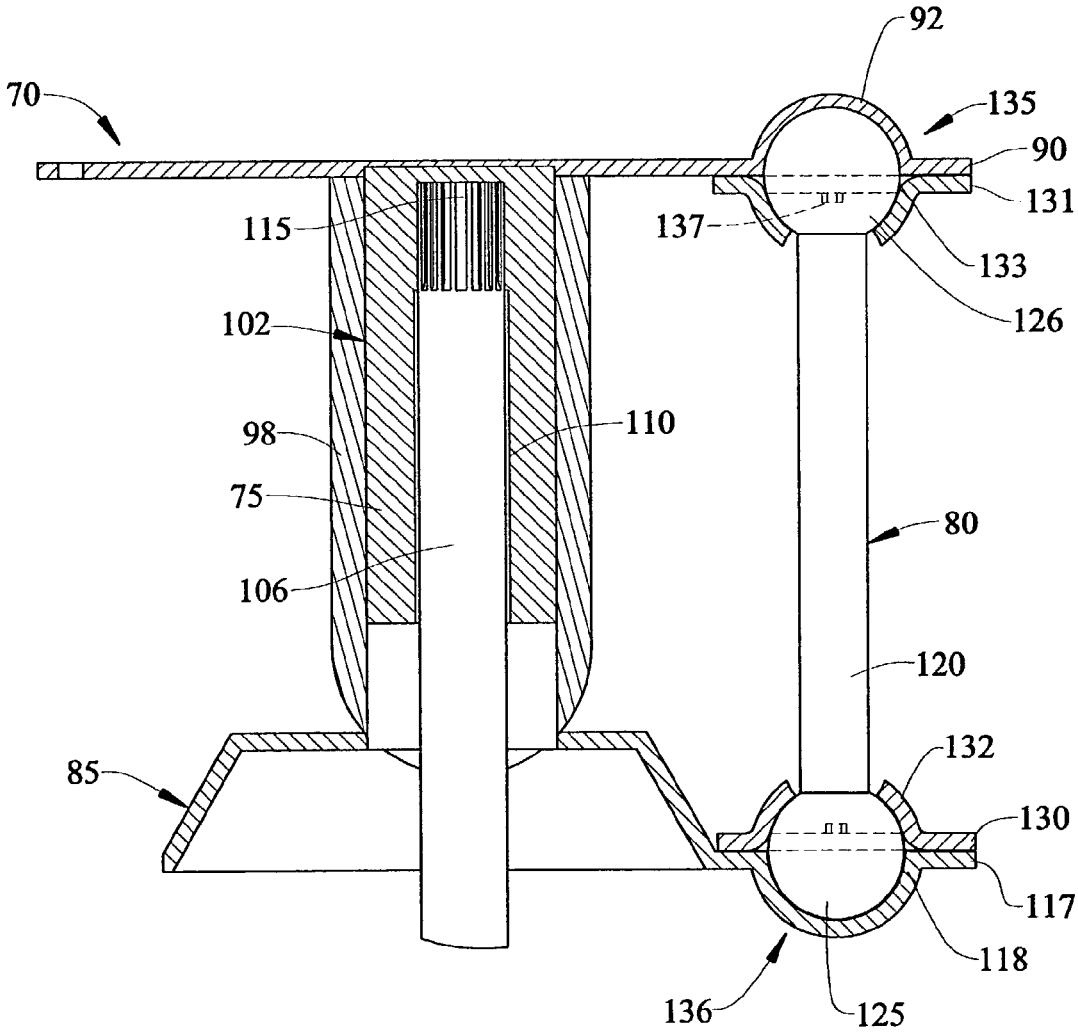
FIG. 3 is a sectional view of the rotating and tipping mechanism of the first embodiment of the present invention.

Drive member 75 constitutes a polygonal block having a top surface 100, a bottom surface 101, a pair of angled faces 102 and a pair of opposing side portions 103. Drive member 75 also includes a pair of pivot pins 107 projecting from adjacent a lower edge of each of the respective pair of side portions 103. A central bore 110, which is defined, at least in part, by an upper shoulder portion 111 of drive member 75 and is adapted to receive a rotating/oscillating drive shaft 106 (see FIG. 3) of a motor or mechanical transmission (not shown), extends substantially from bottom surface 101 to top surface 100. In a preferred form of the invention, drive member 75 is secured to drive shaft 106 by a mechanical fastener 112 and washer 113 through shoulder portion 111. Preferably, washer 113 constitutes a lock-type washer which prevents fastener 112 from becoming loose due to the rotation of drive member 75. As will be detailed more fully below, central bore 110 defines a central axis of rotation of drive member 75. In a preferred embodiment as depicted in FIG. 3, a portion of central bore 110 is adapted to receive a splined portion 115 of drive shaft 106 such that drive member 75 is fixed for rotation with drive shaft 106 about the first pivotal axis 76.

Pivot link 80 provides the mechanism which establishes the second pivotal axis 82 by interconnecting tipping member 70 and spinner bracket 85. Spinner bracket 85 is fixedly mounted within inner tub 10 and includes a flanged portion 117 having a lower ball cup 118. With reference to both FIGS. 2 and 3, pivot link 80 includes a bar element 120 having a first end terminating in a threaded portion and a second end terminating in a lower pivot ball 125. While lower pivot ball 125 is shown pre-assembled, it should be understood that any method of fastening lower pivot ball 125 to bar element 120, whereby ball 125 is fixedly mounted to bar 120, is acceptable. Pivot link 80 also includes upper pivot ball 126 adapted to be threadably attached to the upper threaded portion of bar 120. Pivot link 80 further includes a pair of pivot ball retaining elements 130, 131, each having a central cup portion 132, 133 adapted to capture and maintain the relative positions of pivot balls 125 and 126 respectively. Ball retaining elements 131 and 130 are fastened to upper and lower ball receiving portions 92 and 118 respectively, thereby creating upper ball socket 135 and lower ball socket 136.

In a preferred form of the invention, pivot ball retaining elements 130 and 131 are respectively fastened to spinner bracket 85 and tipping bracket 90 by screws 137 in a manner which permits rotation of pivot balls 125 and 126 within ball sockets 136 and 135 respectively. However, it should be readily apparent to those skilled in the art that other fastening arrangements could be equally used for this purpose.

Figure 2:
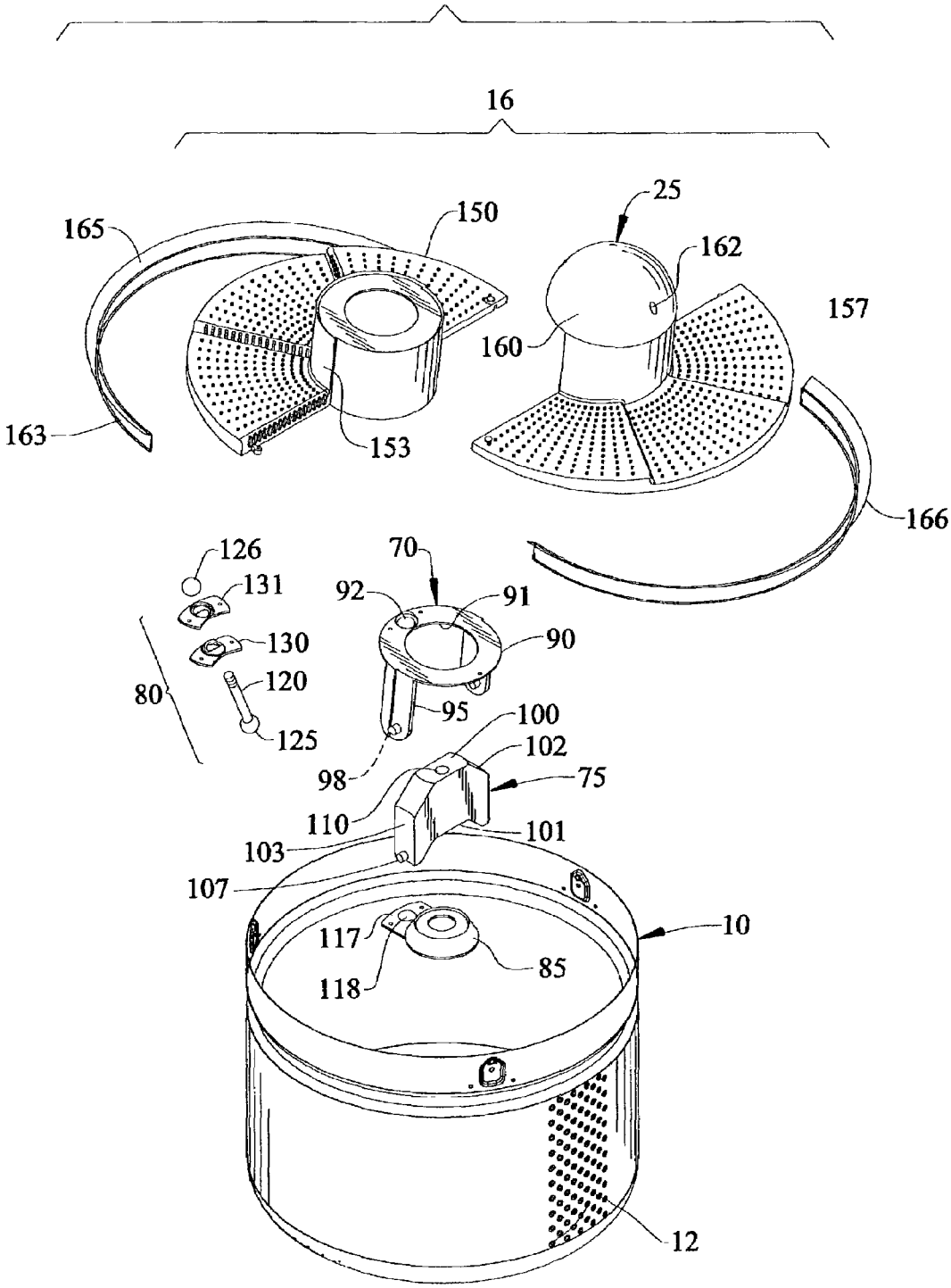
FIG. 2 is an exploded view of the rotating and tipping agitator mechanism in accordance with a first embodiment of the present invention.

The final component of the overall mechanism is agitator assembly 16. As shown in FIG. 2, agitator assembly 16 includes a first semi-circular section 150 having plural sloped teeth 20 provided to cause a ratcheting action between a load of clothes and agitator assembly 16. That is, as agitator assembly 16 advances, the clothes are directed forward. As the agitator retreats, the clothes load slides over sloped teeth 20 like a washboard, thereby establishing a scrubbing action and helping to turn over the clothes.

Integrally formed with first section 150 is a raised cylindrical portion 153 which forms part of a mounting surface for tipping member 70. Similarly, agitator assembly 16 includes a second semi-circular section 157 having plural sloped teeth 20 provided to facilitate movement of clothes within inner tub 10. Integrally formed with second section 157 is a raised dome portion 160. When assembled, cylindrical portion 153 and dome portion 160 join to form central hub 25. Central hub 25 is configured such that tipping member 70 is joined to hub 25 by a plurality of fasteners (not shown) at various mounting locations 162. Finally, arranged about agitator assembly 16 is a flexible seal 163, shown as a first section 165 and a second section 166. In accordance with a preferred form of the invention, seal 163 is provided to prevent clothing from entering internal areas of machine 2. While flexible seal 163 is shown depicted as two distinct sections, it should be understood that the seal can be designed as a one-piece assembly.

Reference will now be made to FIGS. 2 and 3 in describing the operation of this preferred form of the present invention. Upon activation, a motor (not shown) rotates drive shaft 106 relative to inner tub 10 for pivotal movement about a rotational axis which also defines first pivotal axis 76, thereby resulting in an oscillatory/rotating movement to drive member 75. Rotation of drive member 75 causes a similar rotation of tipping member 70 about this rotational or pivotal axis 76. Pivot link 80, which interconnects tipping member 70 with inner tub 10 as described above, restricts the rotational movement of tipping member 70. The rotation of tipping member 70 forces upper ball 126 to travel along an arc defined by the second pivotal axis 82, thereby causing tipping member 70 to also pivot about the second pivotal axis 82. Consequently, the pivotal movement of tipping member 70 about the second pivotal axis 82 imparts the required vertical movement to agitator assembly 16.

Figure 4:
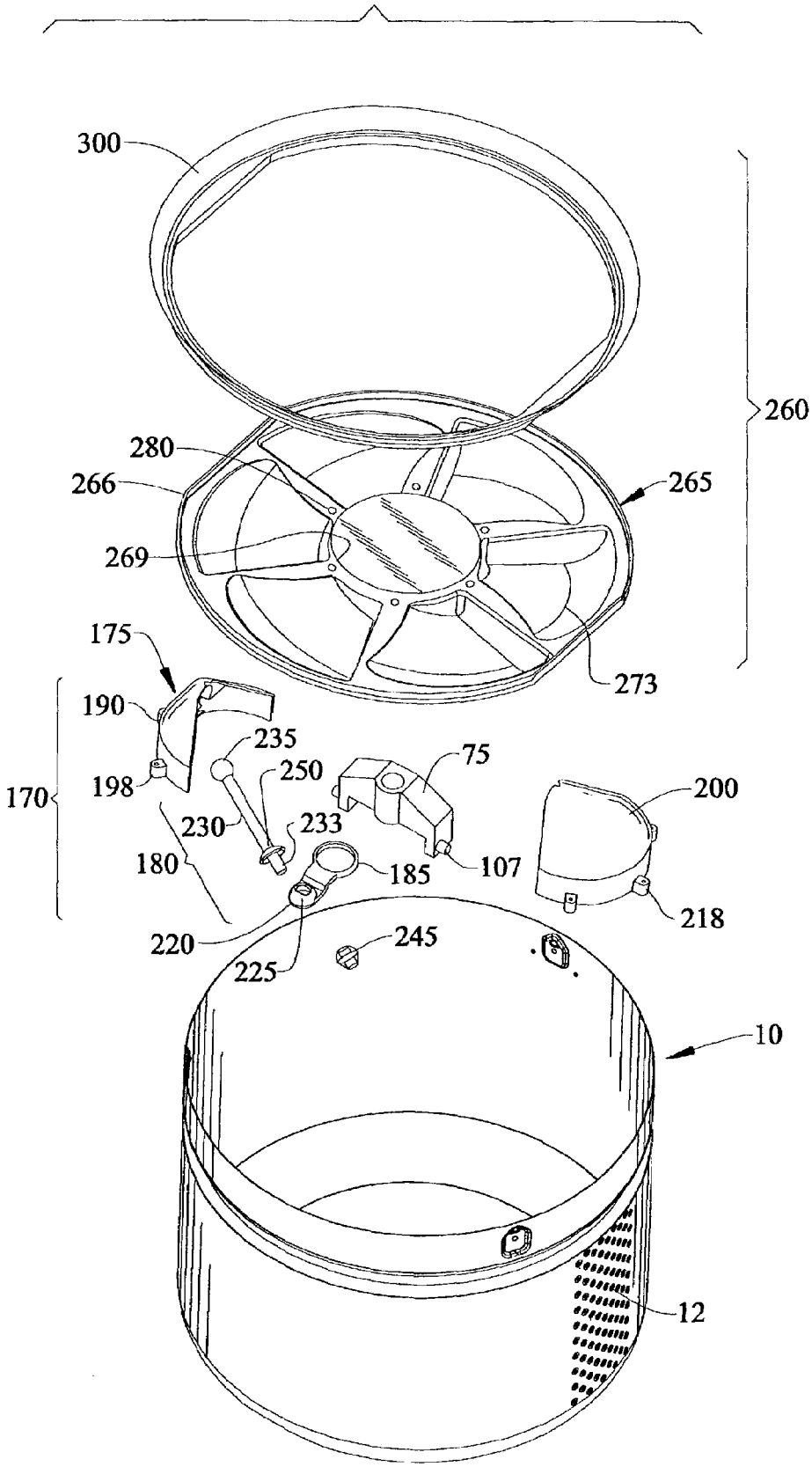
FIG. 4 is an exploded view of a rotating and tipping mechanism constructed in accordance with a second embodiment of the present invention.
Figure 5:
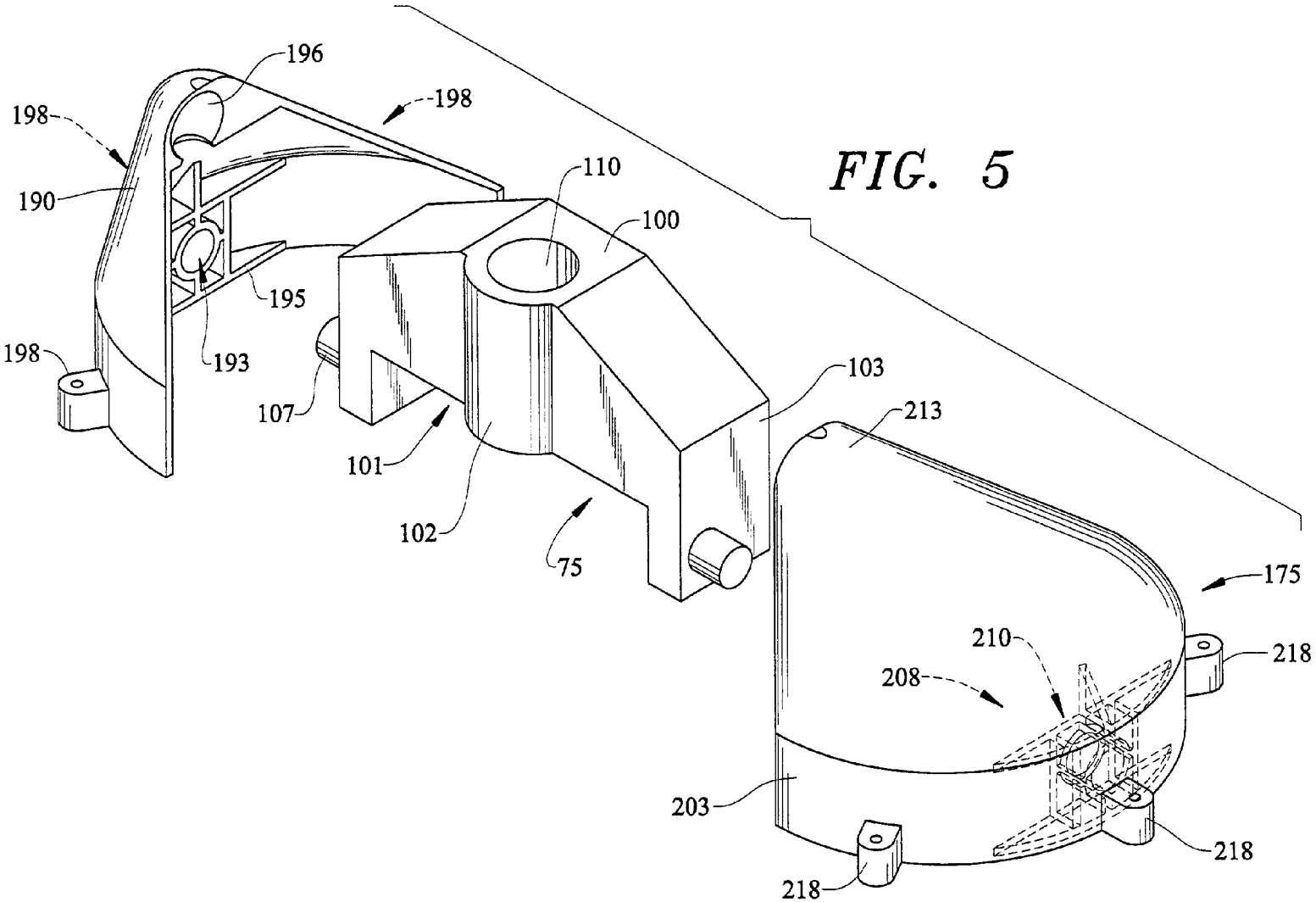
FIG. 5 is an enlarged exploded view of the rotating and tipping mechanism of the second embodiment of the present invention.
Figure 6:
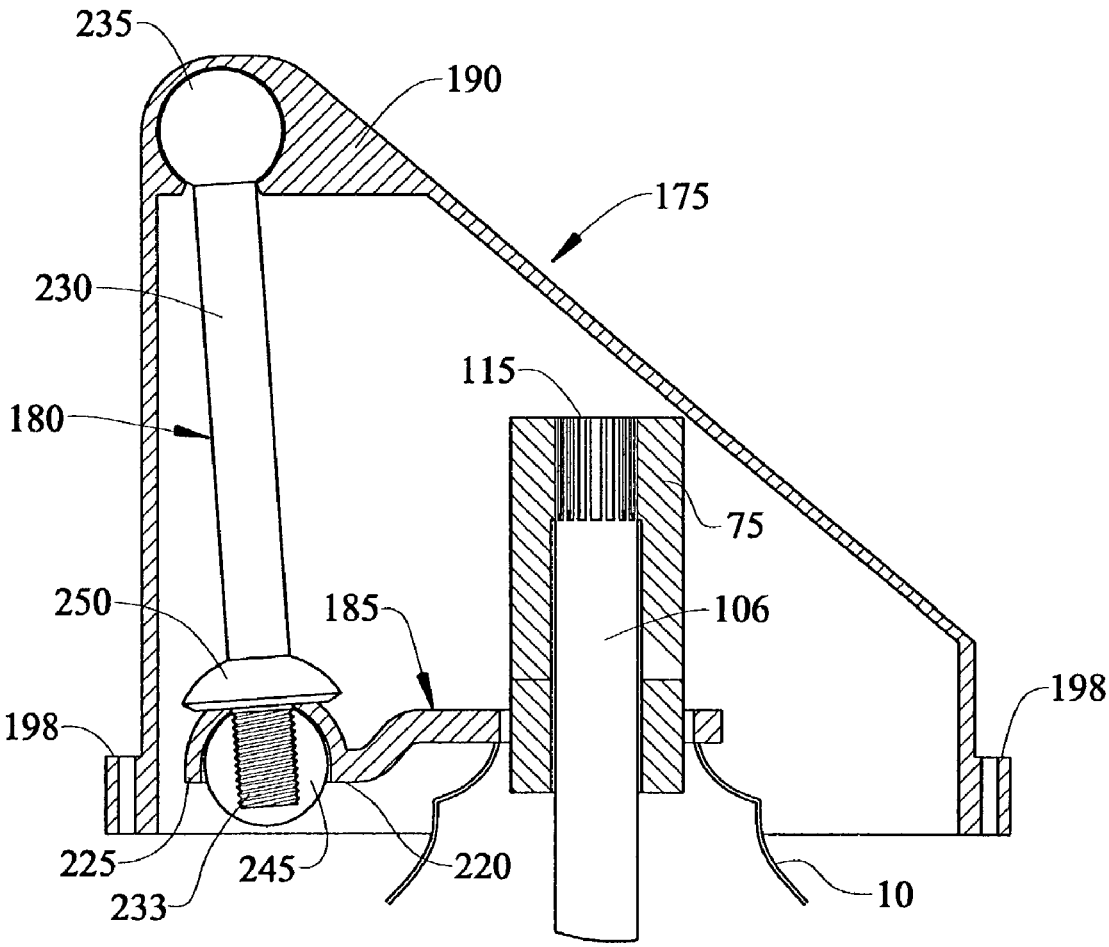
FIG. 6 is a cross-sectional view of the modular rotating and tipping mechanism of the second embodiment of the present invention.

FIGS. 4–6 illustrate another preferred form of the present invention. Similar to the embodiment set forth above, a tipping mechanism 170, including a modular tipping member 175, drive member 75, pivot link 180, and an inner tub or spinner bracket 185 secured to inner tub 10 through a lock or retaining nut 186, is mounted within washing machine 2. Modular tipping member 175 is mounted to drive member 75 for pivotal movement about a rotation axis which also defines a first pivotal axis 176. Pivot link 180 interconnects tipping member 175 with inner tub or spinner bracket 185 such that rotation of drive member 75 causes tipping member 175 to pivot about a second pivotal axis 188 thereby imparting vertical movement to tipping member 175. Having described the interrelationship of the components of this form of the present invention, a detailed description of each of the component parts follows.

Referring initially to FIG. 5, tipping member 175 includes a first semi-frusto-conical section 190 including a pivot journal 193 arranged in a molded support web 195 on a portion of section 190. A pivot socket section 196 is provided in an upper region of section 190 and a plurality of mounting lugs 198 are disposed about an outer periphery of section 190. Tipping member 175 further includes a second semi-frusto-conical section 203 which substantially constitutes a mirror image of first section 190. As with first section 190, second section 203 includes a pivot journal 208 supported by a web 210. A pivot socket section 213 is provided in an upper portion of section 203, and a plurality of mounting lugs 218 are disposed about an outer periphery of section 203.

In a preferred form of the invention, tipping mechanism 170 is formed by positioning pivot link 180 and drive member 75 into first section 190 by placing an upper ball 235 of pivot link 180 into socket section 196, and positioning drive member 75 such that one pivot pin 107 aligns with and is inserted into pivot journal 193. Subsequently, second section 203 is aligned with and joined to first section 190 such that upper ball 235 is positioned within socket section 213 and pivot pin 107 is received in pivot journal 208. In this manner, tipping member 170 is configured with a substantially frusto-conical shape.

In accordance with this second embodiment, drive member 75 is identically constructed to that set forth above. Therefore, the preferred structure thereof will not be reiterated here. Pivot link 180 provides the mechanism which establishes the second pivotal axis by interconnecting tipping member 175 and spinner bracket 185. Spinner bracket 185 is fixedly mounted to inner tub 10 and includes a flanged portion 220 having a lower ball cup 225. As best shown in FIG. 6, pivot link 180 includes a bar element 230 having a first end terminating in a threaded portion 233 and a second end terminating in a upper pivot ball 235. While upper pivot ball 235 is shown pre-assembled, it should be readily understood that any method of fastening pivot ball 235 to bar element 230 whereby ball 235 is fixedly mounted to bar element 230 is acceptable. Pivot link 180 further includes lower pivot ball 245 mounted on threaded portion 233 of bar element 230, and a sliding element 250 adapted to engage lower ball cup 225 to provide an interface between pivot link 180 and lower ball cup 225.

As shown in FIG. 4, agitator assembly 260 includes an agitator plate 265 having an outer peripheral edge 266 and a central opening 269. Disposed about agitator plate 265, between the outer edge 266 and central opening 269, are a plurality of sloping portions 273 which cause a ratcheting action between a clothes load and agitator assembly 265 during operation of appliance 2. In a manner similar to that described above, as the agitator assembly 265 advances, the clothes load is carried forward. As agitator assembly 265 retreats, the clothes load slides over sloped portions 273 like a washboard, thereby increasing a scrubbing action and helping turn over the clothes. Additionally, arranged about the periphery of central opening 269 are a plurality of holes 280 provided for fastening agitator assembly 260 to tipping member 175. In a preferred form of the invention, tipping member 175 passes through central opening 269 to form a central hub. Holes 280 are adapted to align with mounting lugs 198 and 218 such that a fastener, e.g., a screw, nut and bolt assembly, or the like (not shown), can join agitator plate 265 to tipping member 175. Finally, arranged about agitator assembly 260 is a flexible seal 300 provided to prevent clothing from entering internal areas of machine 2 by closing a gap between agitator assembly 260 and inner tub 10 in a manner corresponding to that described above with respect to the first embodiment.

Reference will now be made to FIGS. 4–6 in describing the operation of a second embodiment of the present invention. Upon activation, a motor (not shown) rotates drive shaft 106 relative to inner tub 10 about a rotational axis resulting in an oscillatory/rotating movement to drive member 75. This rotation of drive member 75 causes a similar rotation of tipping member 175 about the rotational axis. Pivot link 180, which is interconnected between tipping member 175 and inner tub 10, restricts the rotational movement of tipping member 175. Instead, the rotation of tipping member 175 forces upper ball 235 to travel along an arc defined by the second pivotal axis 188, causing tipping member 175 to pivot about the second pivotal axis 188. Consequently, the pivotal movement of tipping member 175 about the second pivotal axis 188 imparts the desired vertical movement to agitator assembly 260.

Although described with respect to preferred embodiments of the invention, it should be readily understood that various changes and/or modifications can be made to the invention without departing from the spirit thereof. Instead, the invention is only intended to be limited by the scope of the following claims.

I claim:

1. A washing machine comprising:

a cabinet shell;

an outer tub mounted within the cabinet shell;

an inner tub rotatably mounted within the outer tub;

an agitator positioned within a bottom portion of the inner tub;

a motor driven drive shaft defining a rotational axis; and a tipping mechanism drivingly interconnecting the drive shaft and the inner tub to the agitator, said tipping mechanism including:

a drive member mounted for co-rotation with the drive shaft, said drive member being adapted to provide rotational movement about the rotational axis;

a tipping member interconnecting the drive member and the agitator, said tipping member being adapted to provide pivotal movement to the agitator about a pivotal axis; and a linking member having a first end pivotally mounted to the inner tub and a second end pivotally mounted to the tipping member, wherein rotation of the drive member about the rotational axis causes the agitator to both rotate about the rotational axis and pivot about the pivotal axis.

2. The washing machine of claim 1, further comprising: a spinner bracket fixedly mounted to the inner tub, said spinner bracket including a flange having a semi-spherical socket.

3. The washing machine of claim 2, wherein the linking member includes a terminal ball movably mounted in the semi-spherical socket.

4. The washing machine of claim 3, wherein the linking member includes a bar element, said ball being removably attached to the bar element.

5. The washing machine of claim 1, wherein the tipping member includes a top portion having an opening therein and a pair of opposing legs, each of said legs including a first end mounted to and extending from the top portion and a second end adapted to be pivotally mounted to the drive member.

6. The washing machine of claim 5, wherein the linking member includes a terminal ball movably mounted in the top portion.

7. The washing machine of claim 6, wherein the linking member includes a bar element, said ball being removably attached to the bar element.

8. The washing machine of claim 1, wherein the agitator is directly secured to the tipping member.

9. The washing machine of claim 1, wherein the agitator includes a plurality of plateau portions on a top surface thereof, said plateau portions being adapted to impart a ratcheting action on a load of laundry contained within the inner tub during operation of the washing machine.

10. The washing machine of claim 9, wherein the plateau portions are sloped.

11. The washing machine of claim 1, further comprising: a flexible seal extending about an outer periphery of the agitator, said seal being adapted to close a gap between the agitator and the inner tub.

12. The washing machine of claim 1, wherein the drive member includes an internal bore, said bore having a splined portion engaging the drive shaft.

13. The washing machine of claim 1, wherein said agitator includes a central opening through which the tipping member extends.

14. The washing machine of claim 1, wherein the tipping member includes first and second mated sections.

15. The washing machine of claim 14, wherein both the drive member and the linking member extend between the first and second mated sections.

16. A method of washing a load of clothes placed upon an agitator in an inner tub of a washing machine comprising:

causing a drive shaft to rotate a drive member about a rotational axis;

causing the drive member to rotate a tipping member about the rotational axis;

restraining a portion of the tipping member through a linking member which is pivotal relative to the inner tub and tipping member such that rotation of the tipping member about the rotational axis also causes tipping of the tipping member; and imparting rotating and tipping motions of the tipping member to the agitator.

17. The method of claim 16, further comprising: imparting a ratcheting action on the load of clothes while washing the load of clothes.

18. The method of claim 16, further comprising: preventing clothes from entering a gap between a periphery of the agitator and the inner tub as the agitator tips and rotates.

* * * * *